US010842261B1

(12) United States Patent
Gonzalez

(10) Patent No.: US 10,842,261 B1
(45) Date of Patent: Nov. 24, 2020

(54) FOLD-DOWN TABLE FOR A BED

(71) Applicant: Alex Gonzalez, Murrieta, CA (US)

(72) Inventor: Alex Gonzalez, Murrieta, CA (US)

( * ) Notice: Subject to any disclaimer, the term of this patent is extended or adjusted under 35 U.S.C. 154(b) by 7 days.

(21) Appl. No.: 16/506,915

(22) Filed: Jul. 9, 2019

(51) Int. Cl.

| | |
|---|---|
| ***A47B 23/02*** | (2006.01) |
| ***A47B 83/04*** | (2006.01) |
| ***A47C 19/22*** | (2006.01) |
| ***A47C 21/00*** | (2006.01) |
| ***A47C 31/00*** | (2006.01) |
| ***A47B 23/00*** | (2006.01) |

(52) U.S. Cl.
CPC ..... *A47B 23/00* (2013.01); *A47B 23/025* (2013.01); *A47B 83/04* (2013.01); *A47C 19/22* (2013.01); *A47C 21/00* (2013.01); *A47C 31/00* (2013.01)

(58) Field of Classification Search
CPC ..... A47C 21/00; A47C 21/02; A47C 21/022; A47C 21/026; A47C 21/028; A47C 31/00; A47C 17/52; A47C 17/62; A47C 19/20; A47C 19/202; A47C 19/205; A47C 19/207; A47C 19/22; A47C 17/86; A47C 19/022; A61G 7/05; A61G 7/0503; A61G 7/0506; A47B 23/02; A47B 23/025; A47B 83/04
USPC .... 5/507.1, 503.1, 504.1, 658, 2.1, 3, 8, 9.1, 5/53.1–53.3, 58, 308
See application file for complete search history.

(56) References Cited

U.S. PATENT DOCUMENTS

| | | | | |
|---|---|---|---|---|
| 102,012 A | | 4/1870 | Kelly | |
| 182,544 A | | 9/1876 | Arnaud | |
| 272,077 A | * | 2/1883 | Mueller | A47C 19/04 5/183 |
| 330,832 A | * | 2/1883 | McBlair | A47C 19/04 5/183 |
| 541,339 A | * | 6/1895 | Thompson | A47C 21/02 5/504.1 |
| 594,846 A | * | 12/1897 | Bennett | A61G 7/015 5/618 |
| 713,529 A | | 11/1902 | Swindell, Sr. | |
| 1,347,271 A | | 7/1920 | Hartman | |
| 1,419,586 A | * | 6/1922 | Plackard | A47C 17/46 5/2.1 |
| 1,473,370 A | | 8/1922 | Heller | |
| 2,257,425 A | | 9/1941 | Mezzetti | |
| 2,554,799 A | * | 5/1951 | Sprunger | A47C 19/022 5/632 |
| 2,739,319 A | * | 3/1956 | Keller | A47C 20/043 5/617 |

(Continued)

*Primary Examiner* — Robert G Santos

(74) *Attorney, Agent, or Firm* — QuickPatents, LLC; Kevin Prince

(57) ABSTRACT

A table for a vertical partition includes a cutout defining a table board that has at least a table bottom edge and two opposing cutout side edges. The table board is pivotally attached at the table bottom edge with at least one bi-directional hinge to the cutout bottom edge. The table board has an elongated slotted bracket pivotally fixed with a pivot bracket to one of the two opposing table side edges. Each slotted bracket is slidably constrained by a retention pin fixed with one of the two opposing cutout side edges. With the table board fixed within the cutout in a raised position, the table board may be pushed to one side of the vertical partition or the other, the bi-directional hinges pivoting the table board down until the retention pin reaches an end of the slotted bracket to maintain the table board in a substantially horizontal position.

14 Claims, 6 Drawing Sheets

(56) References Cited

U.S. PATENT DOCUMENTS 2,870,459 A 10/1956 Zabielski
2,933,737 A * 4/1960 Schiffmann ..... A47C 19/22 5/308
3,351,960 A * 11/1967 Burkholder ..... A47C 19/022 5/635
3,386,110 A * 6/1968 Vanhentenrijk et al. ..... A47C 17/38 5/3
3,419,921 A * 1/1969 Flood ..... A47C 19/22 5/308
3,564,627 A * 2/1971 Allard et al. ..... A47B 23/025 5/507.1
3,952,342 A 4/1976 Hart
4,070,715 A * 1/1978 Reppas ..... A47C 17/62 5/2.1
4,253,204 A 3/1981 Tasaka
4,280,744 A 7/1981 Nakano
4,318,195 A * 3/1982 Reppas ..... A47B 85/00 312/240
4,506,927 A 3/1985 Lombardo
4,724,555 A * 2/1988 Poehner ..... A61G 7/0506 5/183
4,809,371 A 3/1989 Spitz
4,958,392 A * 9/1990 Cannady ..... A47C 19/022 5/507.1
5,036,556 A * 8/1991 Wieland ..... A47C 19/022 5/53.1
5,425,148 A 6/1995 Ashcraft
5,509,158 A * 4/1996 Morrison ..... A47C 21/028 5/504.1
5,513,574 A * 5/1996 Collins ..... A47B 5/06 108/33
5,699,565 A * 12/1997 Petterborg ..... A47C 21/028 108/132
6,088,849 A 7/2000 Lieber
6,505,365 B1 * 1/2003 Hanson ..... A61G 7/005 5/510
6,986,176 B1 * 1/2006 Lin ..... A47C 19/022 5/503.1
7,036,160 B1 5/2006 Pecoraro
7,082,882 B2 8/2006 Heimbrock
7,140,052 B2 11/2006 Monestier
7,360,260 B2 * 4/2008 Gallawa ..... A47B 83/04 108/134
7,774,872 B2 8/2010 Sanders
8,739,332 B2 * 6/2014 Hutchison ..... A61G 5/1094 5/279.1
8,793,823 B2 * 8/2014 Baugh ..... A47C 19/022 5/280
9,289,063 B2 * 3/2016 Baugh ..... A47C 19/022
9,980,562 B2 5/2018 Schulman
10,111,529 B2 10/2018 Ray
10,575,631 B2 * 3/2020 Baugh ..... A47B 5/06
10,660,809 B2 * 5/2020 Graves ..... A61G 7/0506
2005/0229307 A1 * 10/2005 Monestier ..... A47C 17/62 5/3
2006/0282945 A1 * 12/2006 Gallawa ..... A47B 83/04 5/2.1
2007/0214567 A1 9/2007 Wandel
2010/0017963 A1 1/2010 Kannan
2011/0197795 A1 * 8/2011 Baugh ..... A47C 19/022 108/50.11
2012/0198615 A1 * 8/2012 Hutchison ..... A61G 5/1094 5/279.1
2014/0310871 A1 10/2014 Nassif
2014/0338120 A1 * 11/2014 Baugh ..... A47C 17/62 5/3
2016/0249736 A1 * 9/2016 Baugh ..... A47C 17/62 5/3
2017/0071806 A1 * 3/2017 Graves ..... A61M 5/1415
2019/0142176 A1 5/2019 Schneidewent

* cited by examiner

FOLD-DOWN TABLE FOR A BED

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to furniture, and more particularly to a bunk bed with a fold-down table arrangement.

BACKGROUND

Fold-down tables are known in the art of furniture manufacturing, such as those that lie against a wall or other vertical surface until folded down and secured in a horizontal position by a user, for example. However, in some situations a fold-down table is desirable on either one side of a vertical partition or the other side, such as with an end board (either a headboard or footboard) of a bed. In some situations with the user in bed it is desired that the table folds down towards the user in bed. Other times it is desirable to work on a table when not laying or seated on the bed, but rather when sitting in a chair adjacent the end of the bed, for example. The prior art does not show a versatile table that can fold down on either side of the vertical partition based on the preference of the user.

Therefore, there is a need for a device that allows a fold-down table to be pivoted downwardly on either side of a vertical partition, such as a footboard or headboard of a bed. Such a needed invention would normally allow the table to be stored flush with the vertical partition so as to occupy no additional space, and would be intuitive to use. Such a needed device would further be relatively inexpensive to manufacture, store and transport. The present invention accomplishes these objectives.

SUMMARY OF THE INVENTION

The present device is a table for a vertical partition, such as an end board of a bed of the type supported on a horizontal surface and having at least a bed frame and two end boards. Each end board is supported by the horizontal surface. In some embodiments the invention includes only the table made to retrofit with an existing bed, while in other embodiments the entire bed is included.

A cutout in one of the end boards defines a table board that has at least a table bottom edge, and two opposing cutout side edges. Preferably the table board further includes a table top edge and the cutout further includes a cutout top edge, such that the table top is generally rectangular in shape. The table board is pivotally attached at the table bottom edge with at least one bi-directional hinge to the cutout bottom edge. Such a bi-directional hinge can pivot at least 180-degrees.

The table board has an elongated slotted bracket pivotally fixed at a first end thereof with a pivot bracket to one of the two opposing table side edges. Each slotted bracket is slidably constrained by a retention pin fixed with one of the two opposing cutout side edges. Preferably the slotted bracket is pivotally fixed to the table board with a thumb-nut and a screw, such that the thumb-nut may be manually tightened or loosened to a desired tension for pivoting. Similarly, the retention pin may include one of the thumb-nuts and the screw such that the friction of the retention pin sliding within the slotted bracket may be manually adjusted.

As such, with the table board fixed within the cutout of the end board and substantially flush with the end board when in a raised, vertical position, the table board may be pushed to one side of the table board or the other, the bi-directional hinges pivoting the table board down until the retention pin reaches an end of the slotted bracket to maintain the table board in a substantially horizontal position. The table board may be in the horizontal position on either side of the end board, as selected by the user.

In a preferred embodiment, the table or bed further includes a latch fixed with the cutout top edge and adapted to retain the table board in the raised position unless selectively moved aside to allow the table board to drop into file horizontal position.

The present invention is a fold-down or drop-down table device that allows a table surface to be pivoted downwardly on either side of a vertical partition, such as a footboard or headboard of a bed. The present invention normally allow the table to be stored flush with the vertical partition so as to occupy no additional space than a standard vertical partition, and is intuitive to use. The present device is relatively inexpensive to manufacture, store and transport. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
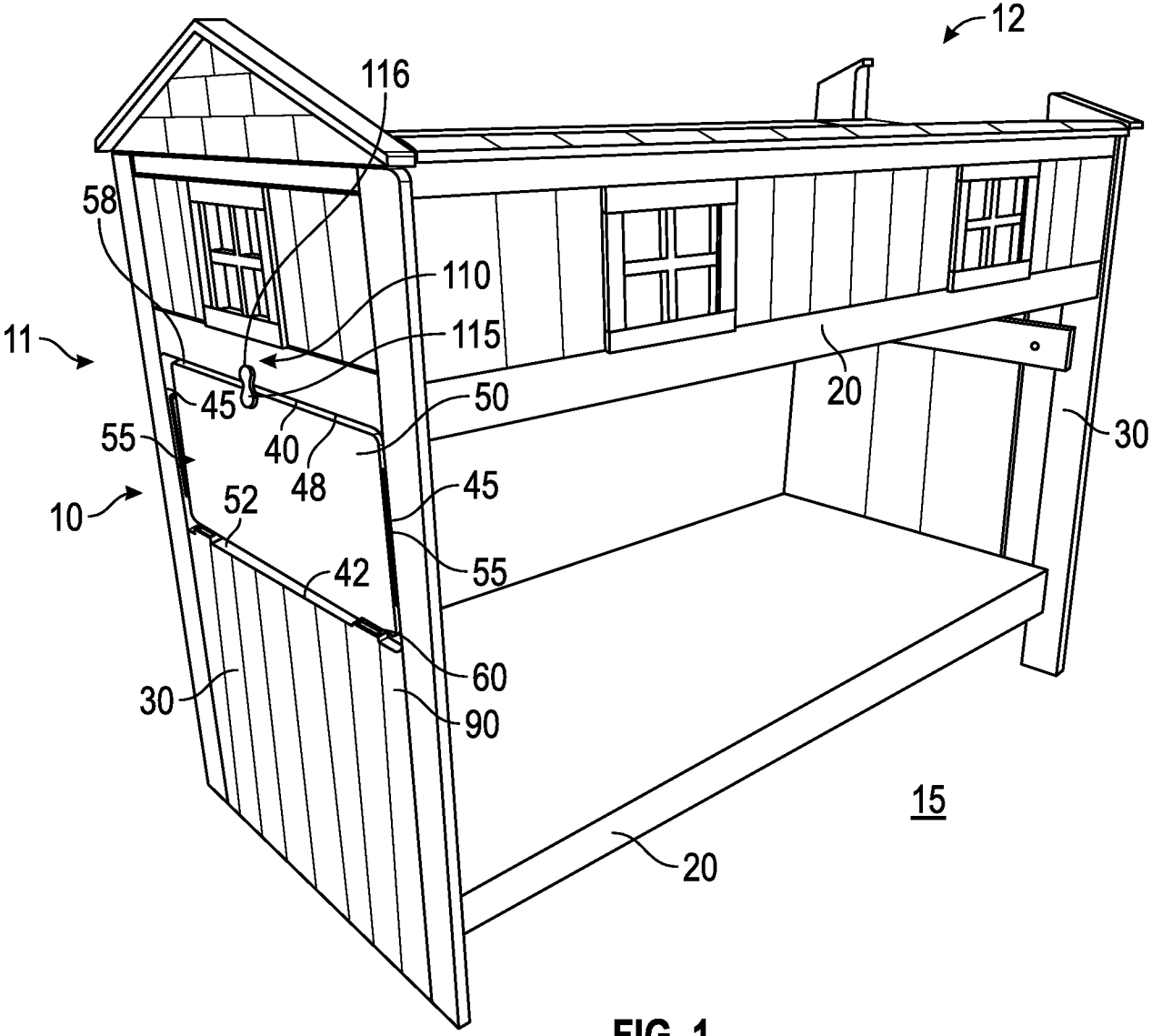
FIG. 1 is a perspective view of the invention, illustrated with a table board in a vertical, raised position on a bunk bed.
Figure 2:
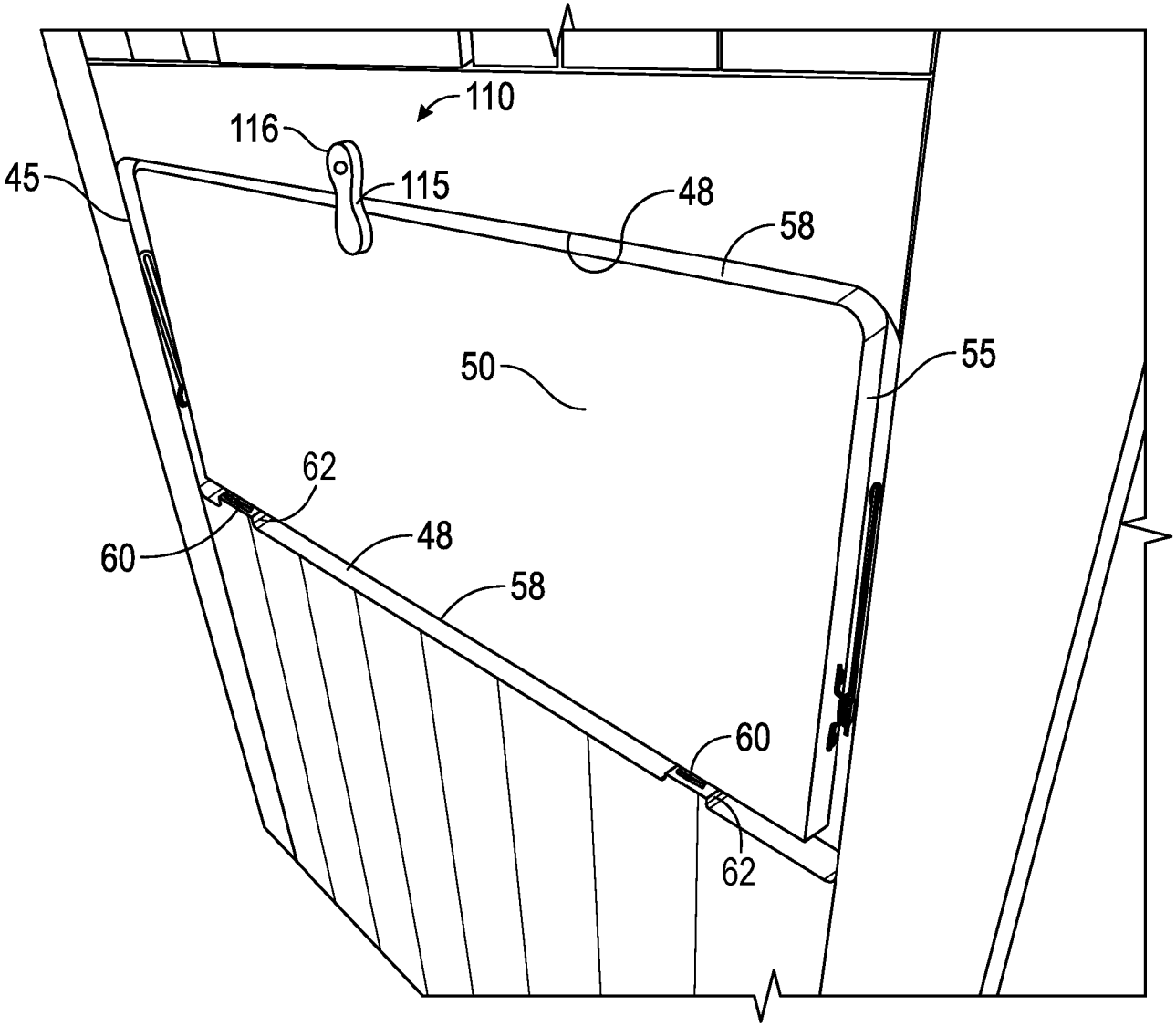
FIG. 2 is an enlarged perspective view of the invention, illustrating the table board flush with an end board of the bed.
Figure 3:
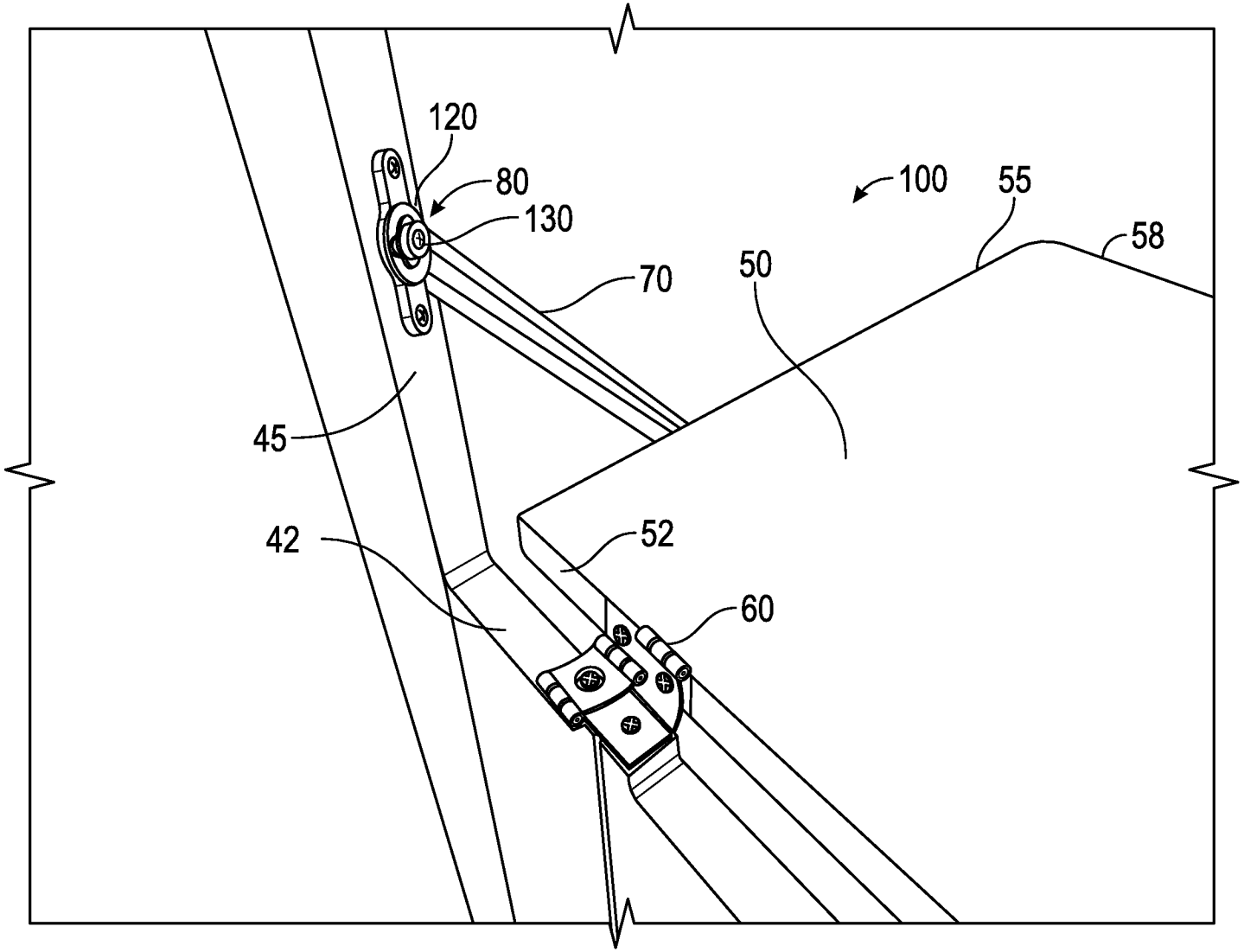
FIG. 3 is an enlarged perspective view showing the table board lowered into a horizontal position, and further illustrating an elongated slotted bracket that stops the table board from pivoting below horizontal.

FIGS. 1-3 illustrate a table 10 for vertical partition 30, such as an end board 30 of a bed 11 of the type supported on a horizontal surface 15 and having at least a bed frame and two end boards 30. Each end board 30 is supported by the horizontal surface 15. In some embodiments the invention includes only the table 10 made to retrofit with an existing bed 11, while in other embodiments the entire bed 11 is included, or just a modified end board 30, such as a footboard or a headboard of the bed.

A cutout 40 in one of the end boards 30 defines a table board 50 that has at least a cutout bottom edge 42, and two opposing cutout side edges 45. Preferably the table board 50 further includes a table top edge 58 and the cutout 40 further includes a cutout top edge 48, such that the table top 50 is generally rectangular in shape. The table board 50 is preferably rigid and has a hard and smooth writing surface on two opposing large sides 54,56 thereof.

The table board is pivotally attached at the table bottom edge 52 with at least one bi-directional hinge 60 to the cutout bottom edge 42. Such a bi-directional hinge 60 can pivot at least 180-degrees.

Figure 4:
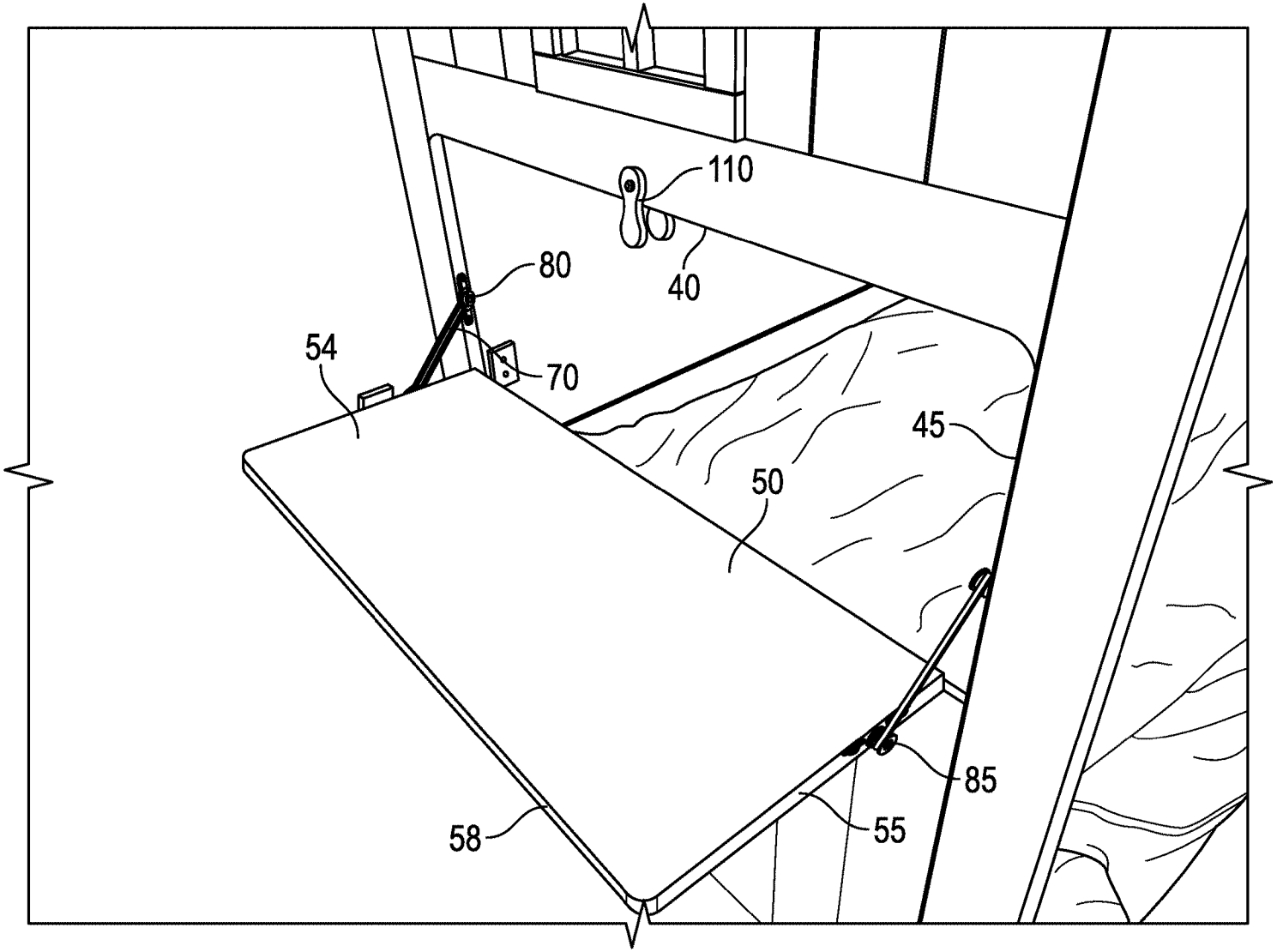
FIG. 4 is a perspective view of the table board in a horizontal position away from the bed in a first configuration.
Figure 5:
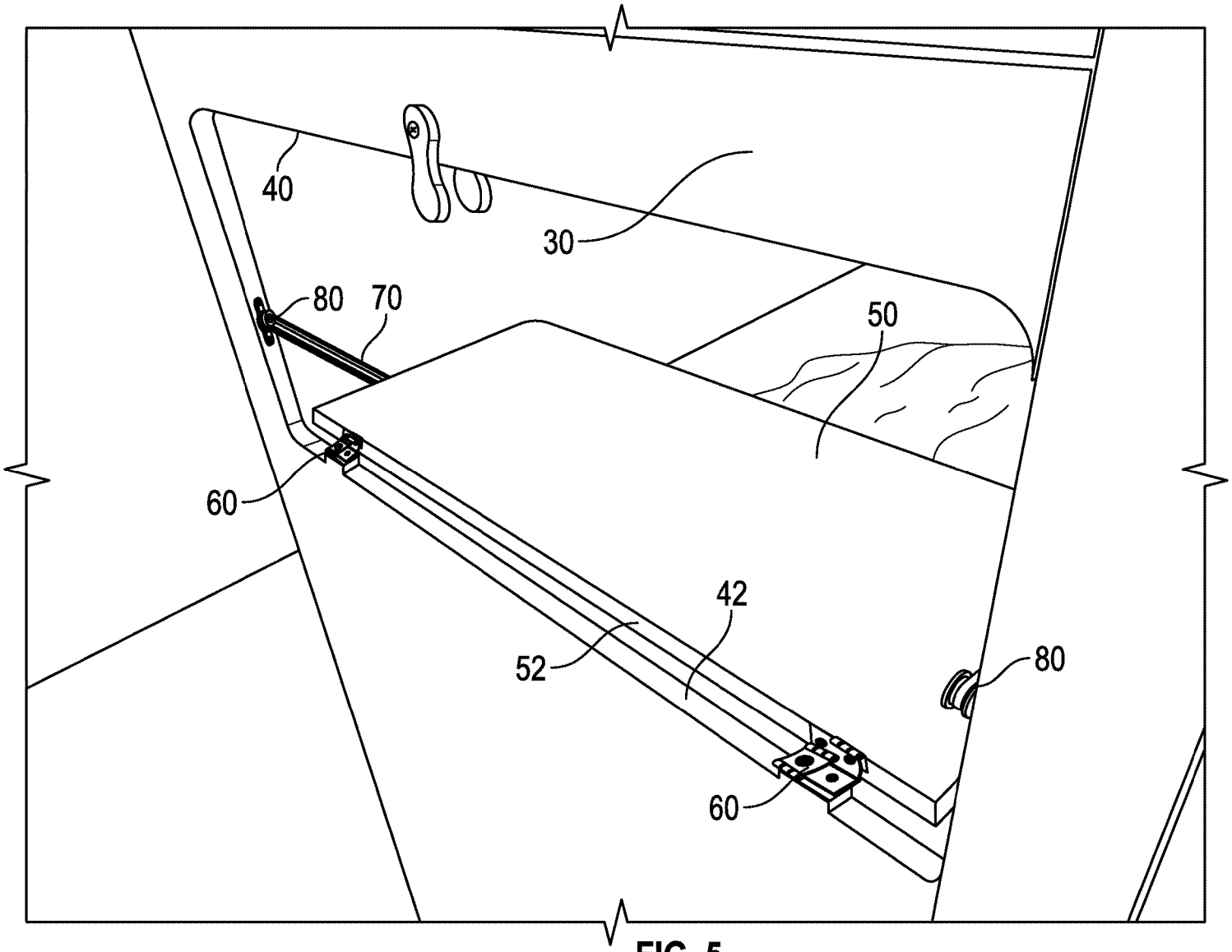
FIG. 5 is a perspective view of the table board in the horizontal position toward the bed in a second configuration.
Figure 6:
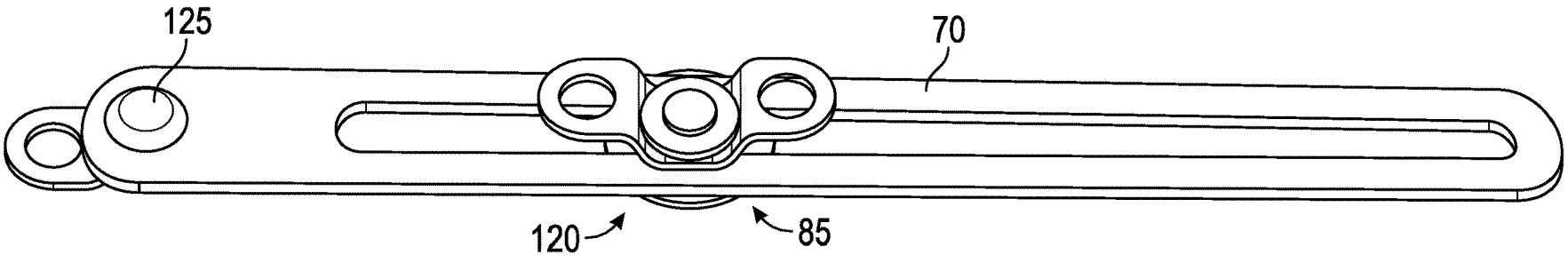
FIG. 6 is an enlarged partial view of the invention, illustrating the elongated slotted bracket with a pair of thumb-nuts and screws, the table board in the raised position.

The table board 50 has an elongated slotted bracket 70 pivotally fixed at a first end 72 thereof with a pivot bracket 85 to one of the two opposing table side edges 55 (FIGS. 4 and 6). Each slotted bracket 70 is slidably constrained by a retention pin 80 fixed with one of the two opposing cutout side edges 45. Preferably the slotted bracket 70 is pivotally fixed to the table board 50 with a thumb-nut 120 and a screw 130 (FIG. 6), such that the thumb-nut 120 may be manually tightened or loosened to a desired tension for pivoting. Similarly, the retention pin 80 may include one of the thumb-nuts 120 and the screw 130 such that the friction of the retention pin 80 sliding within the slotted bracket 70 may be manually adjusted. The screw 130 traverses a slot 74 of the slotted bracket 70. The slot 74 is sized such that at one end of the slot 74 the screw 130 contacts the slotted bracket 70, which prevents further sliding of the screw 130 within the slot 74. The position of the slotted bracket 70 on the table side edge 55 and the cutout side edge 45 is such that when the screw 130 contacts the end of the slot 74, the table board 50 is substantially horizontal (FIGS. 4 and 5). The elongated slotted bracket 70 and associated hardware is preferably made from a rigid, strong metal material.

As such, with the table board 50 fixed within the cutout 40 of the end board 30 and substantially flush with the end board 30 when in a raised, vertical position 90, the table board 50 may be pushed to one side (a first configuration, FIG. 4) of the end board 30 or the other (a second configuration, FIG. 5), the bi-directional hinges 60 pivoting the table board 50 down until the retention pin 80 reaches an end of the slotted bracket 70 to maintain the table board in a substantially horizontal position 100. The table board 50 may be in the horizontal position 100 on either side of the end board 30, as selected by the user.

In a preferred embodiment, the table 10 or bed 11 further includes a latch 110 fixed with the cutout top edge 48 and adapted to retain the table board 50 in the raised position unless selectively moved aside to allow the table board 9 to drop into the horizontal position 100. The latch 110 may be made of a rigid material such as wood, plastic or metal, and include a pair of downwardly pivoting latch arms 115 that are each pivotally attached with a screw 116 or the like with the end board 30. Each latch arm 115, when oriented downwardly by gravity, prevents one side 54,56 of the table board 50 from moving out of the vertical position 90.

Further, preferably each bi-directional hinge 60 is mounted to a raised portion 62 of bottom edge 42 of the cutout 40 so that a gap is created between the bottom edge 42 of the cutout 40 and the bottom edge 52 of the table board 50, the gap being sufficiently large to inhibit a child's fingers from becoming pinched therebetween.

While a particular form of the invention has been illustrated and described, it will be apparent that various modifications can be made without departing from the spirit and scope of the invention. For example, the illustrations show that the bed 11 is a bunk bed, but other single bed or other types of beds may be utilized. Likewise, the end board 30 may not even necessarily be part of a bed, but might instead be an office cubical partition, part of a doorway, or other vertical structure that may benefit from including a built-in table board 50 that can pivot downward on either side thereof. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A table for a vertical partition, comprising:

a cutout in the vertical partition defining a table board having at least a table bottom edge and two opposing table side edges, the cutout having at least a cutout bottom edge, and two opposing cutout side edges;

the table board pivotally attached at the table bottom edge with at least one bi-directional hinge to the cutout bottom edge;

the table board having an elongated slotted bracket pivotally fixed at a first end thereof on either of the two opposing table side edges, each slotted bracket slidably constrained by a retention pin fixed with one of the two opposing cutout side edges;

whereby with the table board fixed within the cutout of the vertical partition and substantially flush with the vertical partition when in a raised, vertical position, the table board may be pushed to one side of the vertical partition or the other, the at least one bi-directional hinge pivoting the table board down until the retention pin reaches an end of the slotted bracket to maintain the table board in a substantially horizontal position.

2. The table of claim 1 wherein the table board further includes a table top edge and the cutout further includes a cutout top edge, the table board being substantially rectangular in shape.

3. The table of claim 2 further including a latch fixed with the cutout top edge and adapted to retain the table board in the raised position unless selectively moved aside to allow the table board to drop into the horizontal position.

4. The table of claim 3 wherein the latch includes a pair of downward pivoting latch arms each pivotally attached with the vertical partition proximate the cutout top edge.

5. The table of claim 1 wherein the at least one bi-directional hinge is exactly two bi-directional hinges.

6. The table of claim 1 wherein the elongated slotted bracket is pivotally fixed at the table side edges with a thumb-nut and a screw.

7. The table of claim 1 wherein the retention pin includes a thumb-nut and a screw, such that the friction of the retention pin sliding within the slotted bracket may be manually adjusted.

8. A bed having a fold-down table, comprising:

a bed structure having at least one bed frame and two end boards, each end board each supported on a horizontal surface;

a cutout in one of the end boards defining a table board having at least a table bottom edge and two opposing table side edges, the cutout having at least a cutout bottom edge, and two opposing cutout side edges;

the table board pivotally attached at the table bottom edge with at least one bi-directional hinge to the cutout bottom edge;

the table board having an elongated slotted bracket pivotally fixed at a first end thereof on either of the two opposing table side edges, each slotted bracket slidably constrained by a retention pin fixed with one of the two opposing cutout side edges;

whereby with the table board fixed within the cutout of the end board and substantially flush with the end board when in a raised, vertical position, the table board may be pushed to one side of the table board or the other, the at least one bi-directional hinge pivoting the table board down until the retention pin reaches an end of the slotted bracket to maintain the table board in a substantially horizontal position.

9. The bed of claim 8 wherein the table board further includes a table top edge and the cutout further includes a cutout top edge, the table board being substantially rectangular in shape.

10. The bed of claim 9 further including a latch fixed with the cutout top edge and adapted to retain the table board in the raised position unless selectively moved aside to allow the table board to drop into the horizontal position.

11. The bed of claim 10 wherein the latch includes a pair of downward pivoting latch arms each pivotally attached with the end board proximate the cutout top edge.

12. The table of claim 8 wherein the at least one bi-directional hinge is exactly two bi-directional hinges.

13. The table of claim 8 wherein the elongated slotted bracket is pivotally fixed at the table side edges with a thumb-nut and a screw.

14. The table of claim 8 wherein the retention pin includes a thumb-nut and a screw, such that the friction of the retention pin sliding within the slotted bracket may be manually adjusted.

* * * * *